United States Patent [19]

Pessina et al.

[11] Patent Number: 4,699,349

[45] Date of Patent: Oct. 13, 1987

[54] SUPPORTING STRUCTURE FOR LOADERS OF SIGNATURES AND SIMILAR ARTICLES, ETC.

[76] Inventors: Giorgio Pessina; Aldo Perobelli, both of Via Timavo, 32, 20037 Paderno Dugnano (Milano), Italy

[21] Appl. No.: 856,684

[22] Filed: Apr. 25, 1986

[30] Foreign Application Priority Data

May 5, 1985 [IT] Italy ..... 21711/85[U]

[51] Int. Cl.[4] ..... F16M 3/00

[52] U.S. Cl. ..... 248/646; 248/429; 269/289 MR

[58] Field of Search ..... 248/646, 650, 657, 424, 248/429, 430; 269/289 MR

[56] References Cited

U.S. PATENT DOCUMENTS 2,599,170 6/1952 Franks ..... 248/646
4,262,963 4/1981 Bauer et al. ..... 248/429 X
4,403,389 9/1983 Coope ..... 248/657 X
4,409,860 10/1983 Moriyama et al. ..... 248/657 X
4,505,464 3/1985 Chitayat ..... 269/289 MR X

*Primary Examiner*—Ramon O. Ramirez
*Attorney, Agent, or Firm*—Bucknam and Archer

[57] ABSTRACT

A support structure for a signature loader or other such loading machine used in conveying of signatures for book binding comprises a fixed base having a rectangular plan form and carrying a movable support frame which is slidable along guides extending transversely of the length of the fixed base and the support frame whereby the support frame may be displaced transversely of its length so as to laterally adjust the delivery position of signatures loaded thereby. Clamping means carried by the movable support frame allow this latter to be fixed in any laterally adjusted position with respect to the fixed base once appropriate adjustments have been made to adapt the signature loader to the dimensions of signatures to be loaded at any one time.

2 Claims, 3 Drawing Figures

SUPPORTING STRUCTURE FOR LOADERS OF SIGNATURES AND SIMILAR ARTICLES, ETC.

BACKGROUND OF THE INVENTION

The present invention relates to a support structure for a signature loader or other such loading machine. In particular the invention relates to a support structure for a signature loader which is adjustable to enable the signatures to be discharged from the loader with one side disposed in correspondence with a predetermined vertical plane, independently of the form and dimensions (thickness, width etc.) of the signatures.

In the process of binding books, the signatures, that is to say the printed sheets which have been folded, are transferred to an automatic feeder which conveys them to subsequent operating machines. In order to transfer the signatures onto the feeder there are currently employed so-called "signature loaders" provided with adjustable margining devices which can be adjusted symmetrically and which are arranged to supply the said sheet feeder via an intermediate conveyor belt. Currently available signature loaders are equipped in such a way as to be able to collect signatures of various different shapes and sizes, but it is a disadvantage of such loaders that the symmetrical adjustment maintains the mid-line of the signatures in register with the longitudinal axis of the loader, which means that the position of the lateral edges of the signatures as they are discharged from the loader will be different for signatures of different sizes. This makes the subsequent feeding operation rather complex if the feeder is feeding a certain type of binding machine which has to receive the signatures with a given edge in a predetermined lateral position in order that these shall line up properly with the various working parts of the binding machine.

OBJECTS OF THE INVENTION

A primary object of the present invention is that of eliminating the above indicated disadvantage by providing a support structure for a signature loader which is adjustable to permit the signatures to be delivered with one edge thereof lying in a predetermined vertical plane, parallel to the axis of the loader itself, regardless of the dimensions or shape of the signatures.

Another object of the present invention is that of providing a support structure for a signature loader which, as well as being adjustable, is structurally simple and of great reliability.

A further object of the present invention is that of providing a support structure for a signature loader which is easily adaptable to the delivery requirements of any binding machine positioned downstream of the loader.

SUMMARY OF THE INVENTION

According to the present invention, there is provided a support structure for a signature loader and the like, comprising:

a fixed base, a movable support frame carried on said fixed base, means on said movable support frame for carrying a signature loader, guide means extending transversely of said fixed base, said guide means guiding said movable support frame in a direction transverse its longitudinal axis, and, means for securing said movable support frame in a selected position along said guide means.

Further characteristics and advantages of the invention will be better understood from a reading of the following description of a preferred embodiment of the support structure itself, illustrated, purely by way of indicative example, in the various figures of the attached drawings.

DESCRIPTION OF THE PREFERRED EMBODIMENT

Figure 1:
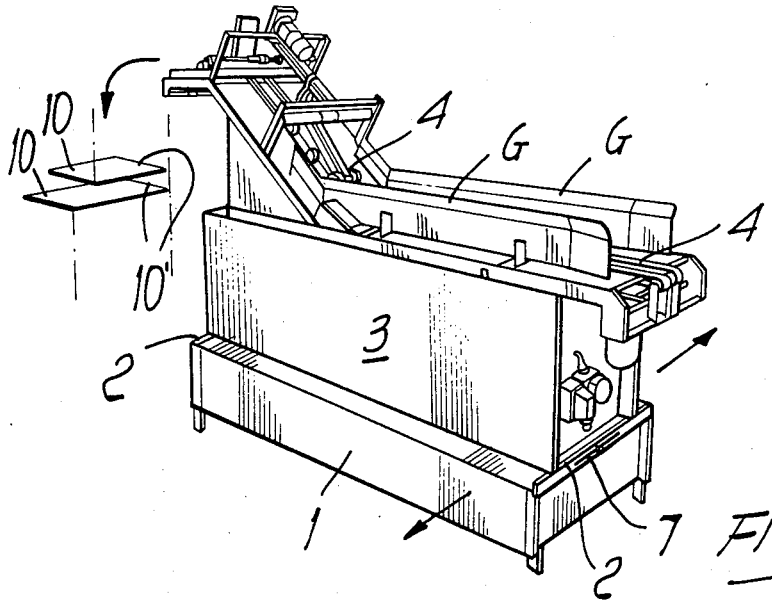
FIG. 1 is a schematic perspective view of a signature loader mounted on the support structure of the invention.

Referring now to the drawings, the support structure of the invention for signature loaders and the like comprises a fixed base 1, having a substantially rectangular plan form which base is provided at its ends, that is the shorter sides of the rectangular plan, with transverse rectilinear guide means 2 for receiving and guiding an upper support frame 3 for carrying a signature loader device of known type. The interconnection between the upper support frame 3 and the guides 2 of the base 1 can obviously be made by means of slides or bearings 5 or other functionally equivalent members.

Figure 3:
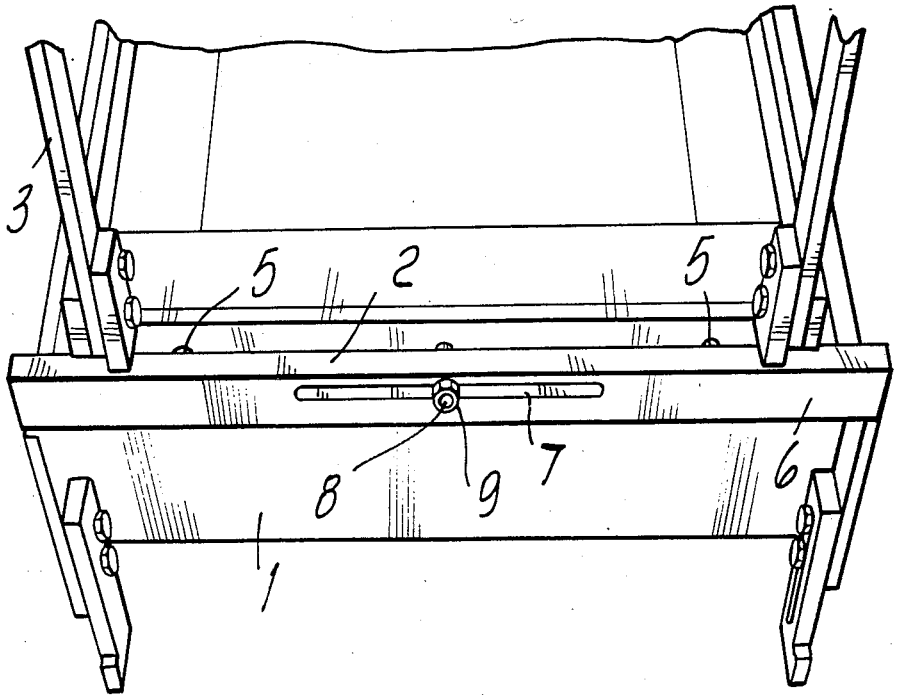
FIG. 3 is a further enlarged perspective view showing the coupling between the fixed base and the movable frame.
Figure 2:
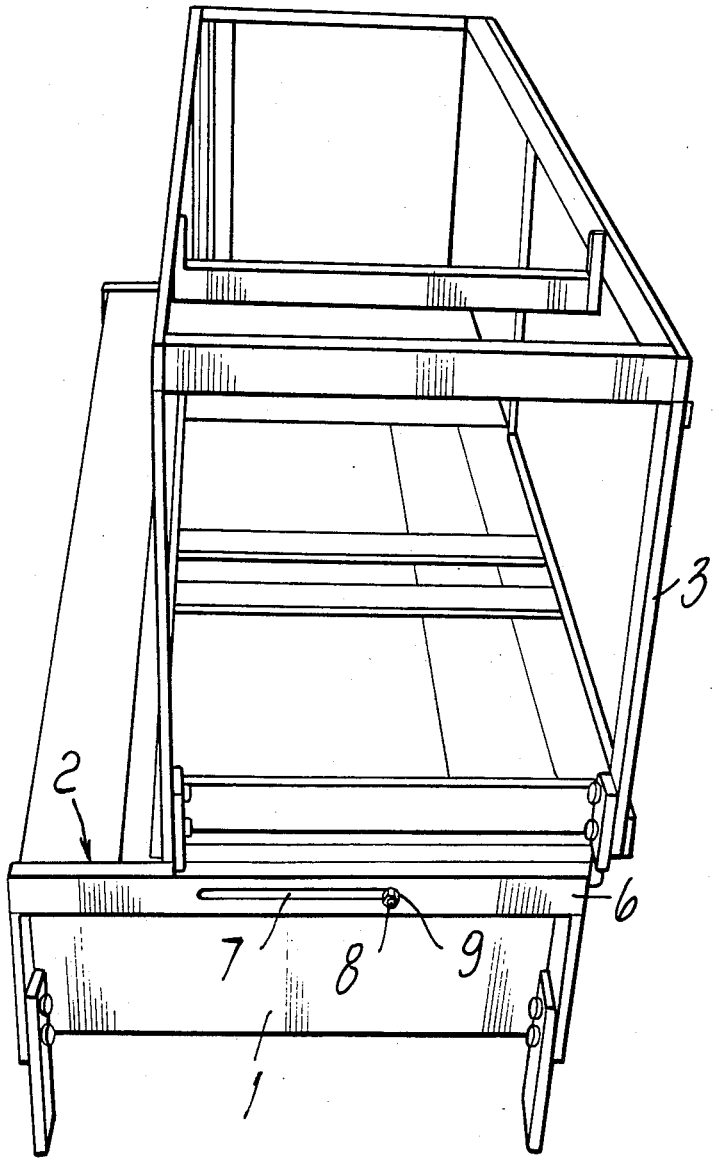
FIG. 2 is a perspective view on an enlarged scale of the support structure of the invention.

As can be seen in FIG. 3, the base 1 has at one end an upstanding wall 6, the top of which defines said transverse guide means 2, extending across the width of the base 1 and having a horizontal slot 7 formed therein. Within this slot there is inserted threaded clamping means 8 in the form of a threaded stud rigidly connected to the said movable frame 3 onto which is screwed a clamping nut 9 able to lock the movable frame 3 in any selected transverse position with respect to the fixed base 1. This lateral adjustment of the movable frame allows the signature loader device 4 carried by the movable frame 3 to be located in the required position so that whatever the width of the signatures 10 these can always be lined up with a given edge 10' lying in a given vertical plane, it being understood that adjustments to the signature loader 4 to accommodate different width signatures are effected by changing the position of lateral guides G on each side of the signature in a symmetrical manner so that the signatures always remain centralised on the loader and symmetrical with respect to a longitudinal centre line thereof. The provision of the lateral adjustment allowed by the movable frame 3 and the transverse guides 2 5, 6 thus allows the whole assembly to be positioned so as to line up a given edge of the signatures with a given vertical plane as they are delivered from the loader.

What is claimed is:

1. A support structure for a signature loader comprising:

a substantially rectangular fixed base, a movable support frame carried on said fixed base and carrying a signature loader, rectilinear guide means extending transversely at the short side ends of said fixed base, said guide means guiding said movable support frame in a direction transverse its longitudinal axis, said fixed base having an upstanding transverse wall at one end thereof extending from side to side of said fixed base, a longitudinal slot being formed horizontally through said upstanding wall, threaded stud means rigid with and projecting from said movable support frame and extending through said longitudinal slot, and threaded clamping nut means threadedly engaged on said threaded stud means whereby to clamp said movable support frame in any selected transverse position with respect to said fixed base.

2. A support structure according to claim 1, wherein said movable support frame is provided with bearings operating to slidingly interconnect said fixed base and said movable support frame.

* * * * *